United States Patent [19]

Miyazawa et al.

[11] 3,948,001

[45] Apr. 6, 1976

[54] CURVED SURFACE GRINDING MACHINE

[75] Inventors: Shinichi Miyazawa, Kawasaki; Kaneyoshi Miyasaka; Hidehiko Takeyama, both of Tokyo, all of Japan

[73] Assignee: Agency of Industrial Science & Technology, Tokyo, Japan

[22] Filed: Sept. 25, 1974

[21] Appl. No.: 509,028

[30] Foreign Application Priority Data

Oct. 5, 1973 Japan ..... 47-112647

[52] U.S. Cl. ..... 51/137; 51/165.92

[51] Int. Cl.[2] ..... B24B 49/16

[58] Field of Search ..... 51/165 R, 165.77, 165.92, 51/137, 143

[56] References Cited

UNITED STATES PATENTS

| | | | |
|---|---|---|---|
| 2,714,787 | 8/1955 | Orr | 51/143 X |
| 3,455,066 | 7/1969 | Estabrook | 51/165 R |
| 3,524,285 | 8/1970 | Rutt | 51/165 R X |
| 3,667,165 | 6/1972 | McDowell | 51/165.77 |
| 3,728,826 | 4/1973 | Woda | 51/165.77 |

*Primary Examiner*—Harold D. Whitehead

*Attorney, Agent, or Firm*—James C. Haight

[57] ABSTRACT

A grinding machine particularly suitable for use in grinding curved surfaces of a pre-machined work, the machine comprising a working table disposed horizontally for fixedly holding a work thereon and movable back and forth in a horizontal direction; a grinding head supported on a machine frame and movable vertically toward and away from the working table, the grinding head including an abrasive grinding tool and a tool-driving electric motor for rotatingly driving the grinding tool; and means for controlling the movement of the working table and grinding head in response to variations in the load current of the tool-driving motor in such a manner as to effect uniform and smooth grinding job on the surfaces of the work.

7 Claims, 1 Drawing Figure

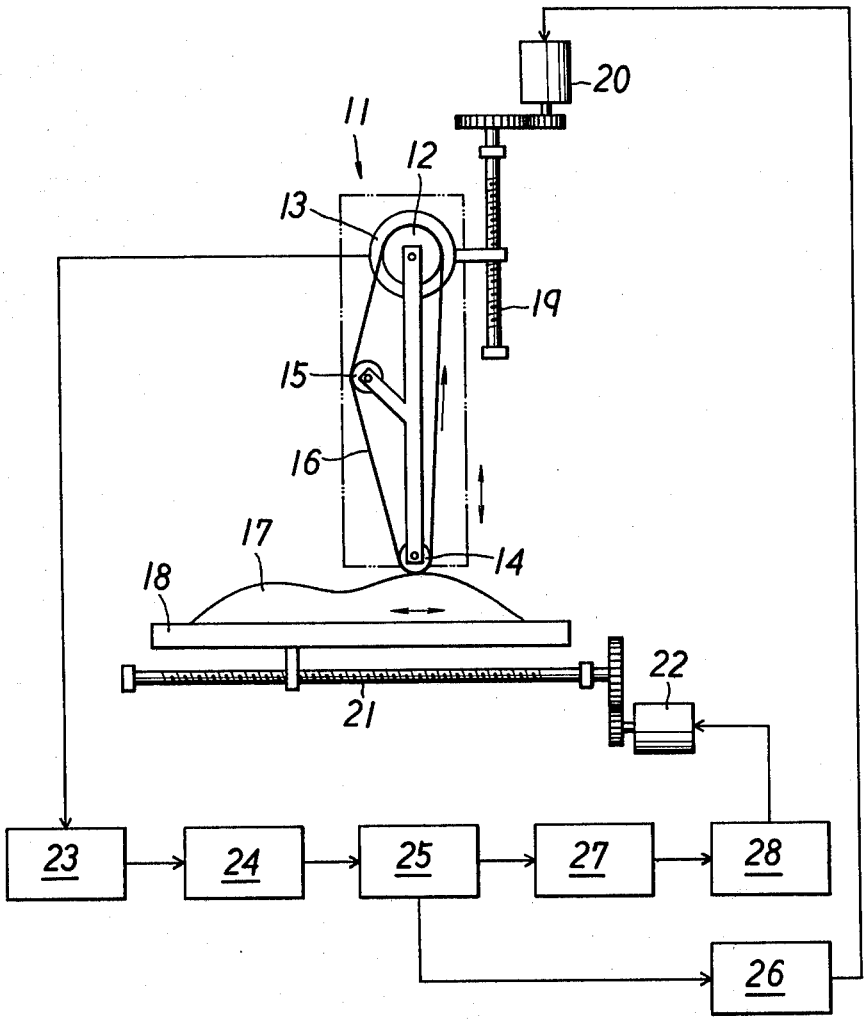
20
11
12
13
19
15
16
17
14
18
22
21
23
24
25
27
28
26

CURVED SURFACE GRINDING MACHINE

This invention relates generally to abrasive machining, and more particularly to a grinding machine particularly suitable for use in finishing curved surfaces of a pre-machined work such as of a press die, plastics-forming mold and the like along the reference curvatures defined by the pre-machining.

In general, the amount of stock removal effected by a grinding tool is substantially proportional to the amount of the load current of a tool-driving motor. From this fact, it follows that the amount of the grinding stock removal can be maintained constant by controlling the grinding machine in terms of the load current of the tool-driving motor. The present invention contemplates providing a curved surface grinding machine which is adapted to operate in response to variations in the load current of the tool-driving motor to grind curved surfaces of a work in the same and uniform amount in improving rough surfaces thereof.

When improving the roughness of curved surfaces of a work on a grinding machine, it is the usual practice to grind the pre-machined surfaces of the work by means of a grinding tool which is controlled to apply a constant pressure on the work surfaces. However, with this constant-pressure grinding method, it is difficult to maintain a constant amount of stock removal on the entire surfaces of the work since the amount of metal abrasion is reduced as the abrasive grains of the grinding tool wear off. In this connection, there is another problem that, where the work includes surfaces which are disposed perpendicular or nearly perpendicular to the movement of the grinding tool, uniform grinding cannot be attained on such surfaces simply by pressing at the same pressure the grinding tool in a vertical direction against the work.

In order to eliminate these drawbacks, the present invention proposes to maintain a constant grinding stock removal throughout the whole process of the grinding operation and on the surfaces of different inclinations by controlling the grinding tool in response to variations in the load current of the tool-driving motor which has close relation with the amount of stock removal effected by the grinding tool as mentioned hereinbefore.

OBJECTS OF THE INVENTION

It is therefore an object of the present invention to provide a grinding machine which is capable of maintaining a constant amount of stock removal on differently curved or inclined surfaces of a work.

It is another object of the present invention to provide a grinding machine which has means for controlling the movement of the grinding tool and working table in response to variations in the load current of the tool-driving motor to effect uniform grinding on the entire surfaces of a work.

It is still another object of the present invention to provide a grinding machine which employs a detector adapted to detect the load current of the tool-driving motor, a comparator connected to the detector and adapted to produce an electric signal indicative of the difference between the load current detected by the detector and a predetermined reference value, and means for controlling movement of the grinding head and working table on the basis of the signal from the comparator to effect uniform grinding on the entire surfaces of a work.

It is a further object of the present invention to provide a grinding machine of the nature as mentioned above, which is simple in construction and reliable in operation.

BRIEF DESCRIPTION OF THE DRAWING

The above and other objects, features and advantages of the invention will become clear from the following description and the appended claims, taken in conjunction with the accompanying drawing in which show by way of example a preferred embodiment of the invention and wherein:

The sole FIGURE schematically shows the curved surface grinding machine according to the present invention.

PARTICULAR DESCRIPTION OF THE INVENTION

Referring to the accompanying drawing, the curved surface grinding machine of the invention includes a grinding head 11 which comprises a driving pulley 12 mounted on an output shaft of a tool-driving motor 13, a contact roller 14, a tension pulley 15, and a grinding or abrasive belt 16 applied around the driving pulley 12, contact roller 14 and tension pulley 15 for circulation therearound. The contact roller 14 is positioned opposingly to a work 17 which is fixedly mounted on a horizontal working table 18 for pressing the circulating abrasive belt 16 against the work surfaces during the grinding operation. The contact roller 14 may of a resilient material such as rubber to avoid localized contact of the grinding belt 16 with the work surface. The grinding head 11 is movable vertically by means of a feed screw 19 which is rotated by a servomotor 20. On the other hand, the working table 18 is movable back and forth in a horizontal direction by means of a feed screw 21 which is rotatingly driven from another servomotor 22.

The driving motor 13 of the grinding head 11 is connected to a load current detector 23 which is adapted to detect the load current I of the motor 13 during the grinding operation by the grinding head 11 acting on the surfaces of the work 17. In order to adjust the response characteristics of the servomotor 20, the detected load current I is fed to a comparator 25 through a filter circuit 24 which has an adjustable time constant. The comparator 25 is adapted to compare the load current I with a predetermined reference value $I_0$ to produce an output voltage $E_1$ which is proportional to the differential $(I-I_0)$ between I and $I_0$. The output voltage $E_1$ of the comparator 25 is fed to a vertical spindle control circuit 26 which is adapted to control the rotational speed of the servomotor 20 in accordance with the comparator output voltage $E_1$. In this instance, if the voltage $E_1$ has a positive value, that is to say, when the load current I of the driving motor 13 of the grinding head 11 is greater than the reference value $I_0$, the servomotor 20 is driven in a direction to lift the grinding head 11 away form the work surface. On the other hand, when the load current I is smaller than the reference value $I_0$, the servomotor 20 is driven in a reverse direction to lower the grinding head 11 toward the work 17.

While, the output voltage $E_1$ of the comparator 25 is also fed to an operational or arithmetic circuit 27, which is adapted to produce a constant voltage $E_0$ and a horizontal spindle control voltage $E_2 = E_0 - E_1$. The voltage $E_2$ is fed to a horizontal spindle control circuit 28 which actuates the servomotor 20 to impart a horizontal movement to the working table 18 so that the relative vectorial speed between the work 17 and the head 11 may be held constant. After the grinding head 11 has traced the surface of the work 17 from one to the other end thereof by the movement of the working table 18, the horizontal spindle control circuit 28 drives the servomotor 22 to move the working table 18 in a reverse direction while the grinding tool is moved by a suitable distance in a direction perpendicular to the working table feed direction, thus completing the grinding of the entire surfaces of the work 17. As mentioned hereinbefore, the filter circuit 24 has an adjustable time constant, so that it is possible to determine as desired the response characteristics of the servomotor 20 with respect to the variations in the load current of the motor 13. In other words, it is possible to control the grinding head 11 either to follow only relatively large undulations on the surfaces of the work 17 or to follow even its small surface variations.

It will be understood from the foregoing description that the curved surface grinding machine of the invention is simple in construction and yet capable of effecting the grinding work of a constant amount along the entire surface of the work without necessitating the provision of a model or template for profiling purposes. In contrast to the known constant-pressure grinding, the amount of stock removal is maintained constant regardless of both the inclinations of the working surfaces in reference to the tool motion and the wear of the abrasive grinding tool.

Though the grinding head 11 is shown to have as a grinding tool an abrasive belt 16 in combination with the driving pulley 12 and contact roller 14 in the preceding embodiment there may be employed a grinding tool of other from such as a grinding wheel or the like instead of the belt 16.

What is claimed is:

1. A curved surface grinding machine, comprising:

a working table for fixedly holding a work thereon and movable back and forth in a longitudinal direction by means of a servomotor;

a grinding head supported on a machine frame and movable perpendicularly toward and away from said working table by means of a servomotor, said grinding head including an abrasive grinding tool and a tool-driving electric motor for driving said grinding tool; and means for controlling the movement of said working table and grinding head in response to variations in the load current of said tool-driving motor in such a manner as to effect uniform grinding on and impart a high degree smoothness to the surface of said work;

said controlling means including a detector adapted to detect the load current of said tool-driving motor, a comparator connected to said detector and adapted to produce an electric signal indicative of the difference between the load current detected by said detector and a predetermined reference value, and means for controlling said servomotors of said working table and grinding head on the basis of the signal from said comparator.

2. A curved surface grinding machine as defined in claim 1, wherein said grinding means, further includes a driving pulley fixedly mounted on the output shaft of said electric motor, a contact roller positioned opposingly to said work on said working table, a grinding belt circulatingly applied around said driving pulley and said contact roller, and a tension pulley located in a suitable position for maintaining said grinding belt in a taut state.

3. A curved surface grinding machine as defined in claim 1, further comprising a filter circuit connected between said detector and said comparator and having an adjustable time constant to preset as desired the response characteristics of the servomotor of said grinding head with respect to variations in said load current.

4. A curved surface grinding machine as defined in claim 1, further comprising a feed screw connected to said servomotor of said grinding head for moving said grinding head perpendicularly toward and away from said working table.

5. A curved surface grinding machine as defined in claim 1, further comprising a feed screw connected to said servomotor of said working table for moving said working table in a longitudinal direction.

6. A grinding machine for removing a constant amount of stock from differentially curved or inclined surfaces of a workpiece, comprising in combination:

a. a table having a longitudinally movable working surface for fixedly holding the workpiece therein;

b. grinding means perpendicularly movable relative to said table working surface for maintaining continuous contact with said differentially curved or inclined surfaces of the workpiece;

c. an electric motor for effecting grinding action by said grinding means; and d. means for effecting and for simultaneously controlling both longitudinal table movement and perpendicular movement of said grinding means with respect thereto in response to variations in the load current of said electric motor in such a manner as to maintain a constant amount of stock removal regardless of the inclination of the working surfaces.

7. The grinding machine of claim 6 including a first servomotor for longitudinally moving said working surface of said table and a second servomotor for perpendicularly moving said grinding means and wherein said controlling means includes a detector adapted to detect the load current of said electric motor for effecting grinding action by said grinding means, a comparator connected to said detector and adapted to produce an electric signal indicative of the difference between the load current detected by said detector and a predetermined reference value, and means for simultaneously controlling said servomotors of said working table and grinding means on the basis of the signal from said comparator.

* * * * *